United States Patent [19]

Stepniak et al.

[11] 4,186,985

[45] Feb. 5, 1980

[54] ELECTRICAL CONNECTOR

[75] Inventors: Frank M. Stepniak, Long Valley; Andrew A. Kominiak, Flanders, both of N.J.

[73] Assignee: Amerace Corporation, New York, N.Y.

[21] Appl. No.: 937,737

[22] Filed: Aug. 29, 1978

[51] Int. Cl.[2] ..... H01R 13/52

[52] U.S. Cl. ..... 339/111; 200/149 A; 339/117 R; 339/143 R

[58] Field of Search ..... 200/144 C, 149 A, 151; 339/111, 45, 46, 12 R, 60 C, 60 R, 94 C, 94 R, 117 R, 143 R

[56] References Cited

U.S. PATENT DOCUMENTS

| | | | |
|---|---|---|---|
| 3,945,699 | 3/1976 | Westrom | 339/111 X |
| 3,957,332 | 5/1976 | Lambert | 339/111 X |
| 4,068,913 | 1/1978 | Stanger et al. | 339/111 |
| 4,116,515 | 9/1978 | Spicer | 339/111 X |

*Primary Examiner*—Roy Lake
*Assistant Examiner*—DeWalden W. Jones
*Attorney, Agent, or Firm*—Richard A. Craig

[57] ABSTRACT

Disclosed herein is a female electrical connector for separably connecting a male contact element with a high voltage circuit. The connector comprises a conductive housing having a first end adapted to receive the male contact element, a second end adapted to be closed and an internal wall surface providing an axially extending opening therebetween. The connector includes an elongate female contact assembly including a tubular conductive piston within and in conductive relationship with the housing and axially movable between a normal first position wherein the piston is maximally spaced from the first housing end and a second position. The piston provides a chamber adjacent the second housing end. The assembly also includes female contact means, for engaging the male contact element, carried by and movable with and in electrically conductive relationship with the piston. The female contact assembly is configured to transmit to the chamber arc-quenching gas which is generated when an arc is truck between the male contact element and the female contact means. The connector further comprises a latch mechanism for retaining the piston in the first position until gas pressure in the chamber attains a predetermined value and for releasing the piston to cause the same to move toward the second position when said pressure exceeds said predetermined value.

19 Claims, 4 Drawing Figures

ELECTRICAL CONNECTOR

FIELD OF THE INVENTION

This invention relates to electrical connectors and more particularly to a female electrical connector suited for use in separably connecting a male contact element with an energized high voltage circuit.

BACKGROUND OF THE INVENTION

Three situations are typically encountered in the connection and disconnection of electrical connectors in power distribution systems. The "loadmake" situation involves the joinder of male and female contact elements, one energized and the other engaged with a normal load. An arc of moderate intensity is struck between the contact elements as they approach one another and until joinder. The "loadbreak" situation involves the separation of such mated male and female contact elements, while they supply power to a normal load. Moderate intensity arcing again occurs between the contact elements from the point of separation thereof until they are somewhat removed from one another. The "fault closure" situation involves the joinder of male and female contact elements, one energized and the other engaged with a load having a fault, e.g., a short circuit condition. Quite substantial arcing occurs between the contact elements as they approach one another and until joinder, giving rise to the possibility of explosion and accompanying hazard to operating personnel.

The prior art teaches the use of materials which emit arc-quenching gas when subjected to arching, thus adequately dissipating the moderate intensity of arcs which occur during loadmake and loadbreak. The troublesome situation is fault closure, in which considerably more arc-quenching gas is required to extinguish the arc. In fact, gas generated pressures during fault closure may be fifty times greater than such pressures during loadmake.

Prior art efforts have reached a point wherein arcing during loadmake and loadbreak is satisfactorily accommodated.

As respects fault closure, certain prior art efforts have looked to the use of the aforementioned arc-quenching gas for assistance in accelerating contact elements into engagement, thus to minimize arcing time. While such prior art gas-assisted contact element engagement efforts have proved advantageous, need exists for continued improvement in connectors relying on arc-quenching gas-assistance in accommodating the fault closure situation through accelerated contact element engagement.

Typical prior art devices which are intended for fault closure use involve connectors each including a female contact assembly which comprises a female contact means and a piston which is movable between a first position and a second position. Gas pressure which is generated by arcing during fault closure accelerates the female contact toward the male contact, thus hastening contact engagement and decreasing the time duration of the arc. Such prior art devices are commonly referred to as "moving piston bushings". Examples are shown in Kotski U.S. Pat. No. 3,542,986 and in Stanger et al. U.S. Pat. Nos. 3,930,709 and 4,068,913, the latter two of which are commonly assigned herewith.

In Kotski U.S. Pat. No. 3,542,986, the female contact element is supported for axial movement by a piston against which arc-generated gas is applied. Thus, a piston assembly is disposed for unitary movement longitudinally within a conductive housing and includes such piston and female contact element and an insulative sleeve encircling the female contact element. The Kotski-type of moving piston bushing attains electrical continuity from the female contact element to the bushing terminal by means of a flexible electrical cable connected at one end thereof to the piston (which is in turn electrically connected to the female contact element) and at its other end to the bushing terminal.

In Stanger et al. U.S. Pat. No. 4,068,913, the Kotski-type device is modified by introduction of a valve transversely of the bore of the piston supporting the movable female contact element and the further introduction of a spring member exerting rearward axial force on the piston assembly and compressible upon forward piston assembly movement. The spring member serves to enhance rapid separation of the contact elements upon withdrawal of the male contact element from the bushing, as during loadbreak. Thus, upon separation of the male contact element from the female contact element, the piston assembly is spring-driven away from the existing male contact element.

In Stanger et al. U.S. Pat. No. 3,930,709, the development of which followed that of Stanger et al. U.S. Pat. No. 4,068,913, an improvement was made over both Kotski U.S. Pat. No. 3,542,986 and over Stanger et al. U.S. Pat. No. 4,083,383, in that the flexible cable which was connected to the piston and the bushing terminal was eliminated, in favor of a metallic louvered spring member encircling the piston and in electrically conductive relationship with both the piston and with conductive housing.

Other typical moving piston bushings of the prior art are shown in Westrom U.S. Pat. No. 3,945,699 and Fischer et al. U.S. Pat. No. 4,083,383. It is not believed necessary to discuss the devices of these two patents in detail.

All known prior art moving piston bushings entail movement of the piston from its first position to its second position during loadbreak. For reasons brought out in detail hereinafter, this piston movement is undesirable in that loadbreak stroke length is maximized.

It is therefore an important advantage of the present invention that it overcomes this undesirable feature of the prior art. This advantage is attained by the provision of means for retaining the piston in its first position except during fault closure.

The prior art moving piston bushings are not reliably reusable after fault closure. Another important advantage of the present invention is to provide a loadbreak bushing which is partially reusable after fault closure, by enabling reliable replacement of certain parts only, and not the entire device.

Among the important objects of the present invention are the provision of a moving piston device having the above advantages.

SUMMARY OF THE INVENTION

A female electrical connector embodying the invention comprises a conductive housing having a first end adapted to receive a male contact element, a second end adapted to be closed and an internal wall surface providing an axially extending opening therebetween. The connector includes an elongate female contact assembly including a tubular conductive piston within and in conductive relationship with the housing and axially movable between a normal or first position wherein the piston is maximally spaced from the first housing end and a second position. The piston provides a chamber adjacent the second housing end. The assembly also includes female contact means, for engaging the male contact element, carried by and movable with and in electrically conductive relationship with the piston. The female contact assembly is configured to transmit to the chamber arc-quenching gas which is generated when an arc is struck between the male contact element and the female contact means. The connector further comprises a latch mechanism for retaining the piston in the first position until gas pressure in the chamber attains a predetermined value and for releasing the piston to cause the same to move toward the second position when said pressure exceeds said predetermined value. The predetermined value of gas pressure is associated only with fault closure, so that the piston is retained by the latch mechanism in the first position except during fault closure.

Furthermore, no part of the connector resists piston movement from the first position toward the second position, once the predetermined gas pressure is exceeded.

Another feature is that the female contact assembly includes a sleeve which is in interlocking engagement with the female contact means which is in threaded engagement with the piston. The interlocking engagement prevents relative rotational and longitudinal movement of the sleeve relative to the female contact means, and the piston is held from rotation relative to the female contact means, whereby the sleeve and the female contact means are removable from the piston and are thereby replaceable after fault closure.

The sleeve has a portion longitudinally remote from the female contact means, and that portion includes a guide of gas-evolving arc-quenching material longitudinally spaced from the female contact means, to provide a gap of predetermined size therebetween.

The conductive housing is provided with an inwardly projecting stop surface confronting the transverse piston surface and spaced therefrom when the piston is in the first position. Engagement of the stop surface and the transverse piston surface determines the second position of the piston.

Further details and features will become apparent from the following description and the accompanying drawing.

DESCRIPTION OF THE PREFERRED EMBODIMENT

Figure 1:
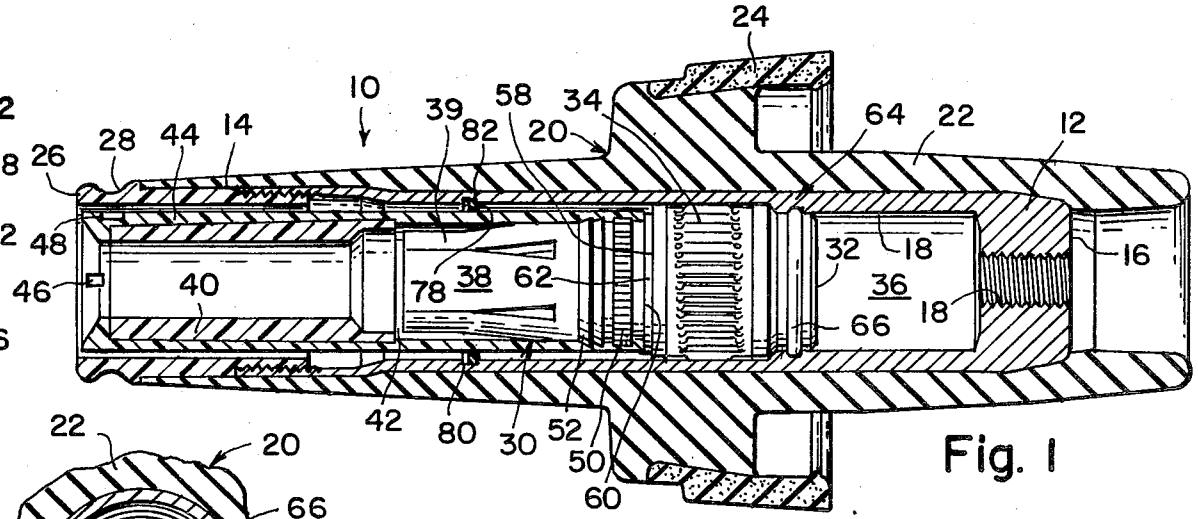
FIG. 1 is a longitudinal view of a female electrical connector embodying the invention, the female contact assembly being shown in elevation and the balance of the connector being shown in section, the female contact assembly being in its first position relative to the balance of the connector.

The drawing shows a female electrical connector, in the form of a bushing insert indicated generally at 10, for use in separably connecting a male contact element (not shown) with an energized high voltage circuit (not shown).

Connector 10 includes a rigid, metallic, electrically conductive housing 12 having a first end 14 adapted to receive the male contact element, a second end 16 which is provided with an internally threaded bore 18 which is adapted to receive a threaded extension (not shown) of an electrical cable connected to a high voltage circuit, such as a transformer (not shown). Second end 16 is thus adapted to be substantially closed in use. Housing 12 also has a wall providing an internal wall surface 18 which provides an axially extending opening between ends 14 and 16.

Connector 10 further includes a casing 20 of elastomeric material surrounding housing 12 and having a radially inner portion 22 of insulating elastomeric material bonded to housing 18 and a radially outer portion 24 of conductive elastomeric material bonded to inner portion 22, all in known fashion.

Connector 10 further includes a tubular bushing insulative nosepiece 26 which is threadedly secured to housing 12 and projects axially from end 14 thereof, in known fashion. As is also known, nosepiece 26 has an encircling external groove 28, to serve as a securing detent for a complementary ribbed portion of an elastomeric housing associated with the male contact element.

Figure 2:
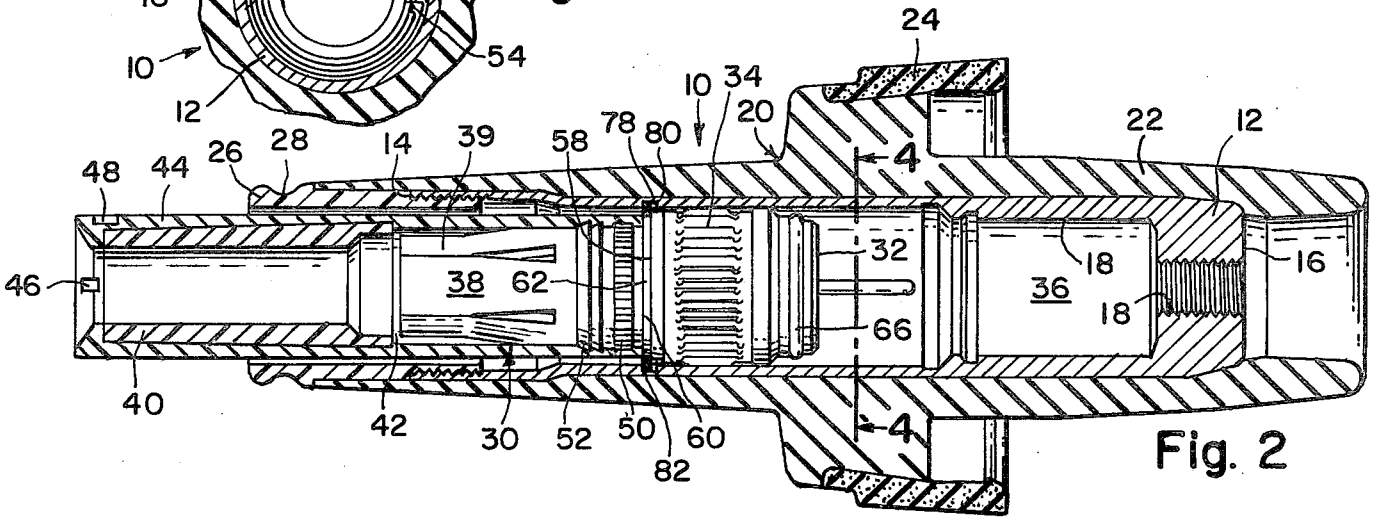
FIG. 2 is a view similar to FIG. 1 but showing the female contact assembly in its second position relative to the balance of the connector.

Connector 10 also includes an elongate female contact assembly, indicated generally at 30 in FIGS. 1 and 2. Contact assembly 30 includes a tubular piston 32 of electrically conductive material, specifically metal, such as aluminum, piston 32 being located within internal wall surface 18 of housing 12, and open at both ends, providing a passage for flow of gas therethrough.

Contact assembly 30 also includes a louvered spring 34 encircling and movable with piston 32 and in sliding engagement with wall surface 18, and in electrically conductive engagement with both piston 32 and housing 12, all as is known from Stanger et al. U.S. Pat. No. 3,930,709.

Piston 32, and the remainder of female contact assembly 30, are normally in a first position longitudinally of housing 12, illustrated in FIGS. 1 and 3, but under certain conditions described hereinafter, contact assembly 30 will move therefrom to a second position, illustrated in FIG. 2. In the first position, piston 32 is maximally spaced from first housing end 14 and in the second position piston 32 is minimally spaced from first housing end 14.

Piston 32 provides female contact element assembly 30 with a chamber 36 adjacent second housing end 16.

Contact assembly 30 further comprises tubular female contact means 38 for releasably receiving the male contact element. Female contact means 38 has radially flexible contact fingers 39 at one end and is carried by and movable with piston 32 and is in electrically conductive relationship therewith. Conveniently, and as known from Stranger et al. U.S. Pat. No. 3,930,709, this may be provided by threaded engagement of an external thread on female contact means 38 with an internal thread in piston 32. Female contact means 38 is open at both ends, providing a passage for flow of gas therethrough.

Contact assembly 30 additionally comprises means for evolving arc-quenching gas in response to an arc being struck between the male contact element and female contact means 38 as the male contact element approaches female contact means 38. As illustrated, such means is a tubular guide 40 of gas-evolving arc-quenching material. Guide 40 functions to receive and guide a follower of gas-evolving arc-quenching material (not shown) which extends from the male contact element and precedes the same into engagement with female contact means 38.

Guide 40 is aligned with female contact means 38 and is preferably spaced therefrom to provide a gap 42 of predetermined size therebetween, in accordance with the teaching of Brown U.S. Pat. No. 3,654,590, commonly assigned herewith.

Contact assembly 30 also has a tubular sleeve 44 of relatively soft insulating plastic material which is secured at a first end to female contact means 38 in encircling relation therewith in a manner described more particularly hereinafter. Sleeve 44 in turn encircling supports guide 40 and is adhered thereto by the use of a suitable adhesive, as taught by Stanger et al. U.S. Pat. No. 4,068,913.

Sleeve 44, adjacent the opposite end thereof (which is remote from female contact means 38), is provided with indentations 46 and 48 which are engageable by suitable wrenching means (not shown), whereby sleeve 44 is rotatable.

Longitudinally spaced toward piston 32 from contact fingers 39, female contact means 38 has longitudinally extending external serrations 50 and circumferentially extending external teeth 52, the latter located longitudinally between serrations 50 and contact fingers 39. Sleeve 44 is assembled with female contact means 38 by aligning the end of sleeve 44 remote from guide 40 with contact fingers 39 and pressing these parts together to a predetermined extent. Teeth 52 and serrations 50 bite into the inner surface of sleeve 44 in such manner that serrations 50 and teeth 52 provide resistance to rotational and longitudinal movement, respectively, of sleeve 44 relative to female contact means 38, whereby the latter has an external configuration which is in interlocking engagement with the interior of sleeve 44, and female contact means 38 is rotationally removable from piston 32 and is thereby replaceable.

Figure 4:
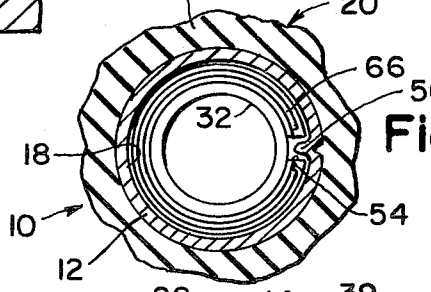
FIG. 4 is a partly fragmentary view taken on line 4—4 of FIG. 2.

Piston 32 has an external longitudinal keyway 54 (FIG. 4) and conductive housing 12 is deformed radially inwardly to provide an internal longitudinal key 56 (FIGS. 2 and 4) in keyway 54, whereby piston 32 is held against rotation relative to conductive housing 18 in all operative positions of piston 32. Stanger et al. U.S. Pat. No. 3,930,709 provides this feature, but at the expense of a key provided by a separate plate screwed in place.

Piston 32 has a transverse surface 58 facing first housing end 14 and female contact means 38 has a transverse surface 60 confronting piston surface 58, and female contact assembly 30 lastly includes a metallic washer 62 between surfaces 58 and 60. Washer 62 surrounds female contact means 38. One face of washer 62 engages surface 58 and the other face of washer 62 engages surface 60. The engagement of washer 62 and surfaces 58 and 60 determines the depth of threaded engagement of female contact means 38 in piston 32, thus providing a cooperative relationship between surfaces 58 and 60, in turn assuring that the predetermined size of gap 42 is maintained as female contact means 38 is threaded into piston 32.

All elements of female contact assembly 30 are movable together, between the first position (FIG. 1) and the second position (FIG. 2).

Figure 3:
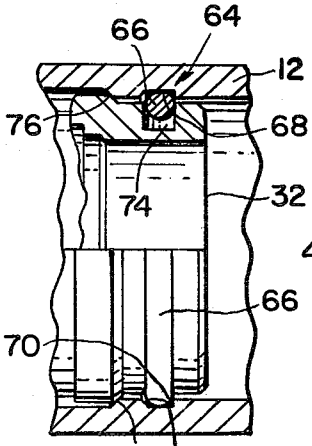
FIG. 3 is an enlarged fragmentary view of a portion of what is shown in FIG. 1, showing in section, the latching means holding the female contact in its said first position.

Connector 10 includes a latch mechanism indicated generally at 64 in FIGS. 1 and 3. Latch mechanism 64 retains piston 32, and the balance of female contact assembly 30 in the first piston, which these parts occupy when the male contact element is fully connected with connector 10 and during loadmake and loadbreak operations. Female contact assembly 30 leaves the first position only during fault closure, during which a high energy arc is struck between the male contact element and female contact means 30 and arc-quenching gas is evolved by guide 40 and the follower associated with the male contact element. The gas passes through the passages through female contact means 30 and piston 32 into chamber 36 and exerts gas pressure on piston 32 in chamber 36. Such gas pressure will be insufficient to cause latch mechanism 64 to release until the gas pressure exceeds a predetermined value, which is associated only with fault closure activity, whereupon latch mechanism 64 releases and gas pressure exerted on piston 32 in chamber 36 causes piston 32, and the rest of female contact assembly 36 to move toward the second position (FIG. 2).

More particularly, latch mechanism 64 is provided by the interengagement of an outwardly-protruding resilient member 66 carried by piston 32 (and a part of female contact assembly 30) and in inwardly-facing circumferential channel 68 in internal wall surface 18 of housing 12. Channel 68 has a sharp side 70 facing first end 14 of housing 12 and a tapered side 72 generally confronting sharp side 70 of channel 68. Piston 32 has an outwardly facing sharp-sided groove 74 and outwardly-protruding resilient member 66 is a spring having an inner portion seated in groove 74 and an outer portion located in channel 68 when piston 32 is in the first position. Spring 66, which, as illustrated is a C-spring of circular cross section and which substantially completely surrounds piston 32, is inwardly flexible out of channel 68 when gas pressure in chamber 36 exceeds the predetermined value, to release latch mechanism 64. This release is controlled and aided by side 72 of channel 68. Groove 74 is of sufficient depth to permit spring 66 to clear tapered side 72 of channel 68. The angle of taper of tapered side 72 of channel 68 is about 45°.

Piston 32 and internal wall surface 18 of housing 12 have confronting external and internal surfaces 74 and 76, respectively, which abut each other when piston 32 is in the first position to prevent piston 32 from moving past the first position in the direction of piston movement away from the second position. Confronting surfaces 74 and 76 are, as shown, similarly tapered. A satisfactory angle of taper is about 45°.

It is significant that no part of connector 10 resists movement of piston 32 from the first position toward the second position, once latch mechanism 64 releases when gas pressure in chamber 36 exceeds the predetermined value. Thus, Stanger et al. U.S. Pat. No. 4,068,913, for example, shows a return spring urging the piston toward its first position, but working against rapid movement of the piston from the first position to the second position, which occurs during the critical mode of operation, i.e., fault closure.

Housing 12 is provided with a stop surface 78 projecting inwardly from the cylinder of internal wall surface 18 and confronting transverse piston surface 58 and spaced therefrom when piston 32 is in the first position. The second position of piston 32 is determined by the engagement of stop surface 78 and transverse piston surface 58. More particularly, internal wall surface 18 has an inwardly-facing groove 80 and a snap ring 82 has an outer portion seated in groove 80 and an inner portion which provides stop surface 78. Groove 80 is sharp-sided and the outer portion of snap ring 82 is permanently seated in groove 80. It is noted that the width of groove 80 may be, and as shown is, slightly wider than the thickness of snap ring 82, so that the latter is longitudinally movable within the constraints of the sides of groove 80.

The inside diameter of snap ring 82, while slightly smaller than the outside diameter of transverse piston surface 58, is slightly larger than the outside diameter of sleeve 44. Also, the inside diameter of nosepiece 26 is slightly larger than the outside diameter of sleeve 44. Thus, once the parts are assembled, piston 32, louvered spring 34 and resilient member 64 are trapped within housing 12, but the rest of female contact assembly 30 is removable and hence replaceable.

When piston 32 is in the second position, sleeve 44 projects outwardly from nosepiece 26, providing visual indication that piston 32 is in the second position. If such visual indication is present, an operator would normally not attempt a closure, since he would not know whether he was closing in a loadmake situation or in a fault closure situation, or even on a dead circuit. However, even if closure is attempted with such visual indication present, it is significant that the follower on the male contact element will abuttingly engage contact fingers 39 of female contact means 38 and push female contact assembly 30 to the first position shown in FIG. 1, in which it is ready for fault closure, before the follower enters female contact means 38 and the male contact element gets within arc-striking distance of female contact means 38.

In fault closure operation, the present invention desirably provides accelerated contact joinder, thus minimizing arcing time, because latch mechanism 64 releases when the predetermined gas pressure associated with fault closure is exceeded, thus permitting such gas pressure to drive female contact means 38 toward the male contact element, unimpeded by a return spring as utilized by the more recent prior art, as exemplified by Stanger et al. U.S. Pat. Nos. 3,930,709 and 4,068,913.

Furthermore, because latch mechanism 64 positively holds piston 32 in its first position except during fault closure, a significant improvement is realized in loadbreak operation over the prior art, as exemplified by Stanger et al. U.S. Pat. Nos. 3,930,709 and 4,068,913. In such prior art, the female contact assembly is moved, against the return spring, to the second position before contact separation begins, thus undesirably maximizing loadbreak stroke. The present invention minimizes loadbreak stroke because gas pressures associated with loadbreak are insufficient to release latch mechanism 64 and female contact assembly 30 does not move during loadbreak. This is significant because devices of the type under consideration are often used in relatively cramped conditions, in which the shortest possible stroke length on loadbreak is highly desirable.

It has been found in this connection that accelerated contact separation during loadbreak does not aid performance significantly and is therefore unnecessary. Thus, the elimination of such accelerated contact separation, resulting from the present invention, is not really a disadvantage at all.

In the device of Stanger et al. U.S. Pat. No. 4,068,913, on loadmake there is no piston movement from the first position, but the device includes a valve in the piston, which valve effectively prevents passage of gas to the chamber between the piston and the closed end of the housing except on fault closure. Thus, the device shown in Stanger et al. U.S. Pat. No. 4,068,913 does not avail itself of the advantages of the expansion chamber of Ruete et al. U.S. Pat. No. 3,539,972 also commonly assigned herewith.

The device of Stanger et al. U.S. Pat. No. 3,930,709 is an improvement over that of Stanger et al. U.S. Pat. No. 4,068,913 in that respect in that the valve of Stanger et al. U.S. Pat. No. 4,068,913 is eliminated and so free flow of gas through the female contact means and the piston into the chamber between the piston and the closed end of the housing is permitted, but, as stated above, undesirably provides for piston movement during loadbreak.

The prior art does not provide a device which is reliably reusable after fault closure. The present invention partially enables the attainment of such reusability by the simple expedient of applying wrenching torque to sleeve 44 to rotate the same, together with guide 40 and female contact means 38 to remove these parts, together with washer 62, from piston 32 and replacing the so removed parts with new ones. In this connection it is noted that the cement which is used in Stanger et al. U.S. Pat. Nos. 3,930,709 and 4,068,913 to secure the tube to the female contact means is unreliable after fault closure activity, so that while it may be possible to remove the tube, the female contact means does not always come with it. In contrast, the interengagement of sleeve 44 with female contact means 38, provided by serrations 50 and teeth 52, assures such replaceability.

Furthermore, Stanger U.S. Pat. No. 4,068,913 discloses a rupturable valve through the piston, so that even if it were possible to replace the female contact means and associated parts, the device would not be suitable for further use. Stanger et al. U.S. Pat. No. 4,068,913 does disclose as an alternative the use of a reclosable valve. However, such reclosable valve may not be 100% reliable on reuse.

It is apparent that the invention is well adapted to the attainment of the above enumerated objects and advantages and others. The disclosed details are exemplary only and are not to be taken as limitations on the invention, except as those details may be included in the appended claims.

The embodiments of the invention in which an exclusive property or privilege is claimed are as follows:

1. A female electrical connector for use in separably connecting a male contact element with an energized high voltage circuit, said connector comprising a rigid conductive housing having a first end adapted to receive said male contact element, a second end adapted to be substantially closed and an internal wall surface providing an axially extending opening therebetween, an elongate female contact assembly including a tubular piston of conductive material within and in electrically conductive relationship with said housing and axially movable between a first position wherein said piston is maximally spaced from said first housing end and a second position wherein said piston is minimally spaced from said first housing end, said piston providing said connector with a chamber adjacent said second housing end, and female contact means for engaging said male contact element, said female contact means being carried by and movable with and in electrically conductive relationship with said piston, said female contact assembly being configured to transmit to said chamber arc-quenching gas which is generated in response to an arc being struck between said male contact element and said female contact means as said male contact element approaches said female contact means, said connector further comprising a latch mechanism for retaining said piston in said first position until the gas pressure of such evolved arc-quenching gas in said chamber attains a predetermined value and for releasing said piston to cause the same to move toward said second position when said pressure exceeds said predetermined value, under the influence of gas pressure exerted on said piston in said chamber.

2. The connector claimed in claim 1 wherein no part of said connector resists movement of said piston from said first position toward said second position, once said predetermined gas pressure is exceeded.

3. The connector claimed in claim 1 wherein said latch mechanism is provided by the interengagement of an outwardly protruding resilient member carried by said piston and an inwardly facing channel in said internal wall surface.

4. The connector claimed in claim 3 wherein said channel has a sharp side facing said first housing end and a tapered side generally confronting said sharp side of said channel.

5. The connector claimed in claim 4 wherein said piston has an outwardly-facing sharp-sided groove and said outwardly-protruding resilient member is a spring having an inner portion seated in said outwardly-facing sharp-sided groove and an outer portion located in said channel when said piston is in said first position, but inwardly flexible out of said channel when said pressure exceeds said predetermined value by engagement of said spring by said tapered side of said channel, to permit said piston to move toward said second position.

6. The connector claimed in claim 5 wherein said resilient member is a C-spring.

7. The connector claimed in claim 6 wherein said C-spring is of circular cross section.

8. The connector claimed in claim 4 wherein the angle of taper of said tapered side is about 45°.

9. The connector claimed in claim 1 wherein said piston and said internal wall surfaces have confronting external and internal surfaces, respectively, which abut each other when said piston is in said first position to prevent said piston from moving past said first position in the direction of piston movement away from said second position.

10. The connector claimed in claim 9 wherein said confronting surfaces are tapered.

11. The connector claimed in claim 1 wherein said assembly also comprises a tubular sleeve aligned with said female contact means and between said female contact means and said first housing end, said female contact means having an external configuration which is in interlocking engagement with the interior of said sleeve, and said female contact means is in threaded engagement with said piston.

12. The connector claimed in claim 11 wherein said interlocking engagement prevents relative rotational and longitudinal movement of said sleeve relative to said female contact means, and said piston has an external longitudinal keyway and said conductive housing is deformed radially inwardly to provide an internal longitudinal key in said keyway to prevent rotation of said piston relative to said conductive housing, whereby said said sleeve and said female contact means are removable from said piston and are thereby replaceable.

13. The connector claimed in claim 11 wherein said sleeve has a portion longitudinally remote from said female contact means and said piston includes a guide of gas-evolving arc-quenching material longitudinally spaced from said female contact means, to provide a gap of predetermined size therebetween.

14. The connector claimed in claim 13 wherein said piston further has a transverse surface facing said first housing end, said female contact means further has a transverse surface confronting said transverse piston surface and said sleeve has a transverse surface confronting said transverse piston surface, said transverse surface being in cooperation to maintain said gap of predetermined size.

15. The connector claimed in claim 14 wherein said female contact assembly further includes a washer surrounding said female contact means and one face of said washer engages said transverse surface of said female contact means and the other face of said washer engages said transverse surface of said piston, the engagement of said washer and said transverse surfaces providing said cooperation.

16. The connector claimed in claim 1 wherein said piston further has a transverse surface facing said first housing end and said conductive housing is provided with an inwardly projecting stop surface confronting said transverse piston surface and spaced therefrom when said piston is in said first position, the engagement of said stop surface and said transverse piston surface determining said second position.

17. The connector claimed in claim 16 wherein said internal wall surface has an inwardly-facing groove, a snap ring has an outer portion seated in said groove and an inner portion which provides said stop surface.

18. The connector claimed in claim 17 wherein said groove is sharp-sided and the outer portion of said snap ring is permanently seated in said groove and said snap ring is longitudinally movable within the constraints of the sides of said groove.

19. The connector claimed in claim 1 wherein said female contact means and said piston together provide an open passage for transmission of gas to said chamber.

* * * * *

UNITED STATES PATENT AND TRADEMARK OFFICE

CERTIFICATE OF CORRECTION

PATENT NO. : 4,186,985

DATED : February 5, 1980

INVENTOR(S) : Frank M. Stepniak et al.

It is certified that error appears in the above—identified patent and that said Letters Patent is hereby corrected as shown below:

Column 1, line 33, change "arching" to --arcing--.

Column 2, line 29, change "4,083,383" to --4,068,913--.

Column 4, line 12, change "18" to --17--; line 23, change "18" to --12--; line 64, change "Stranger" to --Stanger--.

Column 5, line 53, change "18" to --12--.

FIG. 1 and the same view on the cover sheet, change reference numeral 18 (applied to the threaded bore near the righthand end of the view) to --17--.

FIG. 2, change reference numeral 18 (applied to the threaded bore near the righthand end of the view) to --17--.

Signed and Sealed this

*Thirtieth* Day of *March 1982*

[SEAL]

*Attest:*

GERALD J. MOSSINGHOFF

*Attesting Officer*

*Commissioner of Patents and Trademarks*